US007438291B2

(12) United States Patent
Kilbane

(10) Patent No.: US 7,438,291 B2
(45) Date of Patent: Oct. 21, 2008

(54) BOARD GAME

(75) Inventor: Patrick Kilbane, Indianapolis, IN (US)

(73) Assignee: Patrick J. Kilbane, Indianapolis, IN (US)

( * ) Notice: Subject to any disclaimer, the term of this patent is extended or adjusted under 35 U.S.C. 154(b) by 95 days.

(21) Appl. No.: 11/534,854

(22) Filed: Sep. 25, 2006

(65) Prior Publication Data

US 2007/0069466 A1 Mar. 29, 2007

Related U.S. Application Data

(60) Provisional application No. 60/720,344, filed on Sep. 23, 2005.

(51) Int. Cl.
*A63F 3/00* (2006.01)

(52) U.S. Cl. ..... 273/242; 273/272; 273/299; 273/430

(58) Field of Classification Search ..... 273/272, 273/242, 299, 243, 431, 308
See application file for complete search history.

(56) References Cited

U.S. PATENT DOCUMENTS 4,607,848 A * 8/1986 Maguire et al. ..... 273/269
4,715,608 A * 12/1987 Burt ..... 273/248
4,998,735 A * 3/1991 Blackwell, III ..... 273/249
5,383,669 A * 1/1995 Vance ..... 273/244
5,454,569 A * 10/1995 Walker ..... 273/236

* cited by examiner

*Primary Examiner*—Vishu K. Mendiratta

(57) ABSTRACT

The present invention relates to a game in which a game surface, a plurality of game pieces, and a plurality of game cards are provided for use in games involving names of people. In the preferred embodiment, the game surface comprises a plurality of ladders having starts, finishes and various spaces; the spaces are associated with certain subjects like Entertainment or Politics. The game cards have clues printed on one side; answers are printed on the other side. Game pieces advance one space along a ladder if a team is able to guess the correct answer; play is ceded to the other team for an incorrect answer. Wipe out spaces permit the other team to select the subject of the game card; game pieces advance one space if the word card is answered correctly, and retreat two spaces if answered incorrectly.

12 Claims, 2 Drawing Sheets

| | FRONT | BACK |
|---|---|---|
| 20 | Wrestling hold with "half" in the name and a gent / first name of Afro-American angel on TV show. | Wrestling hold with "half" in the name (Half Nelson) and a gent (Man) / first name of Afro-American angel on TV show. (Della Reese)<br>Nelson Mandella<br>Political activist of African National Congress who led fight against "apartheid". Won Nobel Peace Prize in 1993 |
| 20 | First syllable of a toast topper / a jail room and first syllable for word for space around the text on a paper / to join by stitches. | First syllable of a toast topper (Margarine) / a jail room (cell) and first syllable for word for space around text on a paper (Margin) / to join by stitches. (sew)<br>Marcel Marceau<br>French mime artist who popularized that art form for millions on stage and on TV. |
| 20 | Name of Stallone's famous movie and sounds like a type of cherry used in drinks-desserts. | Name of Stallone's famous movie (Rocky) and sounds like a type of cherry used in drinks-desserts. (Maraschino)<br>Rocky Marciano<br>U.S. boxer who defeated Joe Louis for World Heavyweight title in 1951. Had 49 bouts and won 48. |
| 20 | Name of manufacturer of early Jeep vehicles and several Month fives. | Name of manufacturer of early Jeep vehicles (Willy) and several Month fives. (Mays)<br>Willy Mays<br>Hall of Fame baseball player of the N.Y. Giants. MVP of National League in 1954 and 1965. Named "Player of the Decade" in 1969. |
| 20 | Sounds like the name for a narrow pass and a nasty person. | Sounds like the name for a deep narrow pass (Gorge) and a nasty person. (Meany)<br>George Meany<br>U.S. labor leader. First President of AFL-CIO. Preferred arbitration and lobbying to staging strikes. |
| 20 | Soccer players target / slang for "what?" and sounds like word for wet, spongy earth; | Soccer players target (Goal) / slang for "what?" (duh) and sounds like word for wet, spongy earth. (Mire)<br>Golda Meir<br>Israeli politician and female elected Prime Minister in 1969. Her efforts thwarted by 4th Arab-Israeli war in 1973 |
| 20 | First name of Fred Mertz's wife in "I Love Lucy" TV show and first syllable of word for someone who sells / opposite of "women". | First name of Fred Mertz's wife in "I Love Lucy" TV show (Ethel) and first syllable of word for someone who sells (Merchant) / opposite of "women". (men)<br>Ethel Merman<br>Singer with a powerful, brassy voice on Broadway and in movies. Her signature song was- There's No Business Like Show Business. |

| | FRONT | BACK |
|---|---|---|
| 20 | Wrestling hold with "half" in the name and a gent / first name of Afro-American angel on TV show. | Wrestling hold with "half" in the name (Half Nelson) and a gent (Man) / first name of Afro-American angel on TV show. (Della Reese)<br><br>Nelson Mandella<br>Political activist of African National Congress who led fight against "apartheid". Won Nobel Peace Prize in 1993 |
| 20 | First syllable of a toast topper / a jail room and first syllable for word for space around the text on a paper / to join by stitches. | First syllable of a toast topper (Margarine) / a jail room (cell) and first syllable for word for space around text on a paper (Margin) / to join by stitches. (sew)<br><br>Marcel Marceau<br>French mime artist who popularized that art form for millions on stage and on TV. |
| 20 | Name of Stallone's famous movie and sounds like a type of cherry used in drinks-desserts. | Name of Stallone's famous movie (Rocky) and sounds like a type of cherry used in drinks-desserts. (Maraschino)<br><br>Rocky Marciano<br><br>U.S. boxer who defeated Joe Louis for World Heavyweight title in 1951. Had 49 bouts and won 48. |
| 20 | Name of manufacturer of early Jeep vehicles and several Month fives. | Name of manufacturer of early Jeep vehicles (Willy) and several Month fives. (Mays)<br><br>Willy Mays<br>Hall of Fame baseball player of the N.Y. Giants. MVP of National League in 1954 and 1965. Named "Player of the Decade" in 1969. |
| 20 | Sounds like the name for a narrow pass and a nasty person. | Sounds like the name for a deep narrow pass (Gorge) and a nasty person. (Meany)<br><br>George Meany<br><br>U.S. labor leader. First President of AFL-CIO. Preferred arbitration and lobbying to staging strikes. |
| 20 | Soccer players target / slang for "what?" and sounds like word for wet, spongy earth; | Soccer players target (Goal) / slang for "what?" (duh) and sounds like word for wet, spongy earth. (Mire)<br><br>Golda Meir<br><br>Israeli politician and female elected Prime Minister in 1969. Her efforts thwarted by 4th Arab-Israeli war in 1973 |
| 20 | First name of Fred Mertz's wife in "I Love Lucy" TV show and first syllable of word for someone who sells / opposite of "women". | First name of Fred Mertz's wife in "I Love Lucy" TV show (Ethel) and first syllable of word for someone who sells (Merchant) / opposite of "women". (men)<br>Ethel Merman<br>Singer with a powerful, brassy voice on Broadway and in movies. Her signature song was- There's No Business Like Show Business. |

*Fig. 2*

BOARD GAME

CROSS-REFERENCE TO RELATED APPLICATIONS

The present application claims the benefit of U.S. Provisional Patent Application Ser. No. 60/720,344, filed Sep. 23, 2005 and entitled Board Game, the text and drawings of which are hereby incorporated by reference in their entireties.

TECHNICAL FIELD OF THE INVENTION

The present invention generally relates to games and, more particularly, to board games.

BACKGROUND OF THE INVENTION

Many board games are known in the prior art and individual games require various skill sets in order to play them effectively. There remains room in the art for additional games that provide an incentive for the players to utilize various combinations of skills in order to be successful at the game. The present invention is directed toward a novel board game that encourages users to utilize skills in crossword puzzles, trivia, vocabulary and mental recall.

BRIEF DESCRIPTION OF THE DRAWINGS

FIG. 2 is a plan view of the front and back sides of seven clue cards from the first embodiment game.

BRIEF DESCRIPTION OF THE EMBODIMENTS

Figure 1:
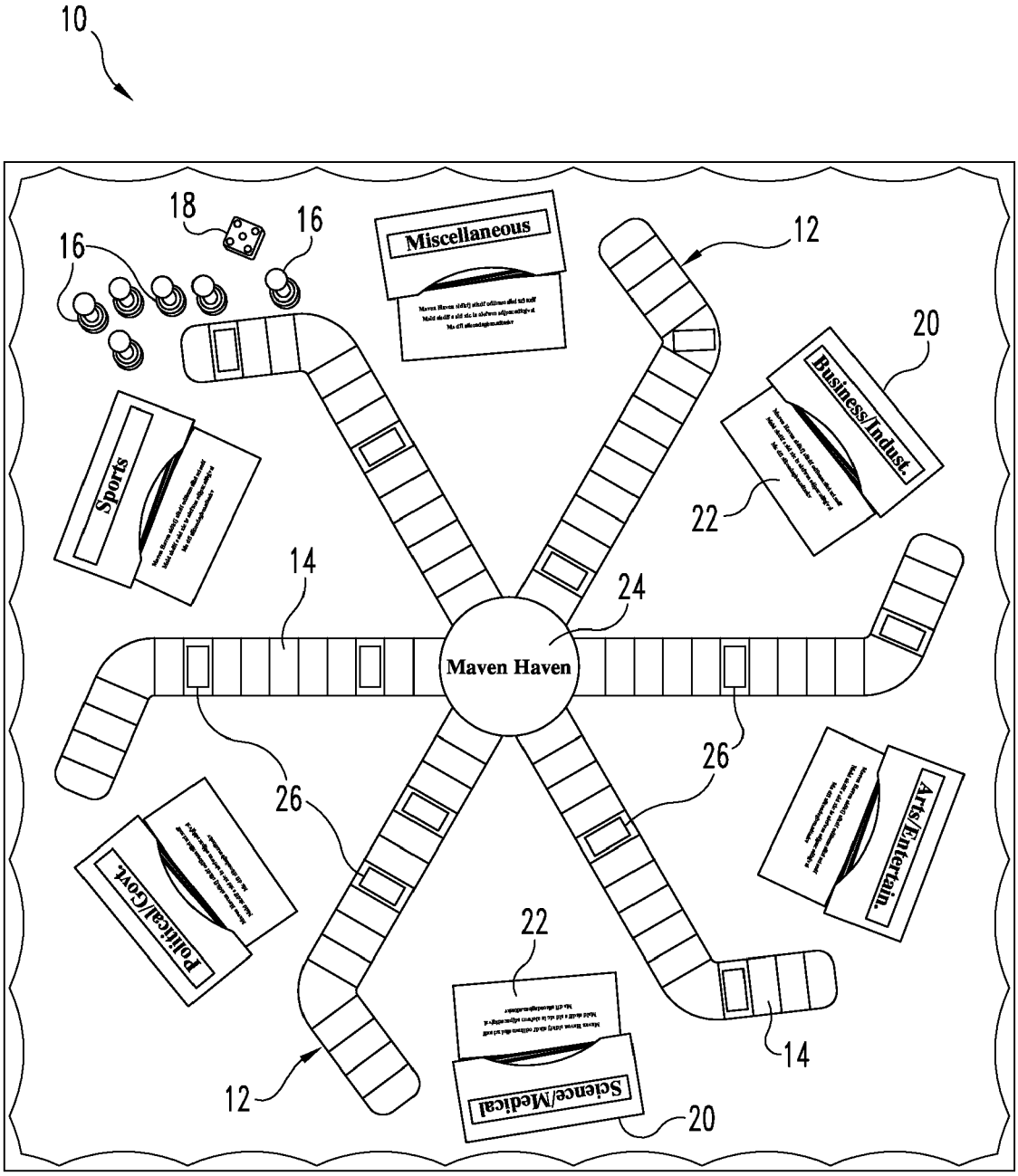
FIG. 1 is a plan view of a first embodiment game playing surface with clue cards placed thereon.

For the purposes of promoting an understanding of the principles of the invention, reference will now be made to the embodiment illustrated in the drawings and specific language will be used to describe the same. It will nevertheless be understood that no limitation of the scope of the invention is thereby intended, and alterations and modifications in the illustrated device, and further applications of the principles of the invention as illustrated therein are herein contemplated as would normally occur to one skilled in the art to which the invention relates.

Referring now to FIG. 1, there is shown a first embodiment game playing surface of the present invention, indicated generally at 10. The game playing surface 10 includes a plurality of ladders 12 that are each divided into a plurality of spaces 14. A player will start play on one of the spaces 14 and will progress to other spaces 14 during the game, as described in greater detail hereinbelow. A plurality of game pieces 16 are provided for marking which space 14 is currently occupied by a player. The game pieces 16 are preferably color coded for ease in distinguishing the positions of various players. The first embodiment game 10 includes six differently colored game pieces 16, although those skilled in the art will recognize that the game 10 could be played with fewer or more game pieces. Additionally, the game pieces 16 can represent the positions of teams of players, wherein each team comprises multiple players who are competing together collectively. A die 18 is provided in order to determine which player starts game play, as described in greater detail hereinbelow.

Shown positioned on the game board 10 are six boxes 20 of clue cards 22. Each card 22 contains a clue, as described in greater detail hereinbelow. The card boxes 20 are preferably arranged by subject area, with the first embodiment including card boxes 20 having clue cards pertaining to the subjects Politics/Government, Arts and Entertainment, Science/Medical, Business/Industrial, Sports, and Miscellaneous. Those skilled in the art will recognize that the present game could be played with fewer or more card boxes 20/subjects and with different subjects than the ones delineated herein.

Play of the first embodiment game is as follows. The object of the game 10 is to decipher the clues on the cards 22 in order to identify a person of fame or notoriety. With each correct answer, the player may advance his game piece 16 one space 14 up the ladder 12. A player must correctly identify at least fifteen celebrities to win the game. Each player (or team of players) selects a game piece 16 and places it on the first space 14 of one of the ladders 12 (i.e. the space 14 farthest from the central area 24). Each ladder 12 includes 15 spaces, all leading to the central area 24, or winner's circle.

Each player takes a turn throwing the die 18. The player who throws the highest number on the die 18 starts first, with play continuing with other players in a clockwise manner once the first player completes his turn. Ties of the die 18 throwing will be broken by having the tying players throw the die 18 again until the tie is broken. Each space 14 on the ladder 12 (with the exception of the "wipe out" spaces 26 described in greater detail hereinbelow) is printed in one of six colors to correspond to the colors of the card boxes 20. Therefore, the spaces 14 each correspond to a different one of the subjects, and landing on a space 14 identifies a box 20 from which a clue card 22 should be drawn. The first player therefore draws a clue card 22 from the box 20 corresponding to the color of the space 14 on which his game piece 16 is located.

Clue cards 22 are double-sided, having a clue on the front side and the answer to the clue on the back side. Seven examples of the clue cards 22 are illustrated in FIG. 2, showing both the front and back of the card. The answer to each clue card 22 in the first embodiment is always a person's name. In other embodiments, the answer may be something other than a person's name. The clue for each clue card 22 provides definitions for words (or portions of words) corresponding to each syllable in the answer. First name clues are separated from last name clues by the word "and." In a multiple syllable name, there is a clue for each syllable with the clues separated by a "/" symbol. The player must determine the words that match the clue definitions and then assemble the words to form the syllables of the answer.

After drawing a clue card 22, the player briefly studies the clue and then places the card 22 clue side up on the board 10 so that the other players may see the clue. After no more than a maximum reasonable time period (to be determined by agreement among the other players), the player announces the name of the celebrity he or she believes has been identified by the clue. To check the answer, one of the other players turns over the clue card 22 and reads the answer aloud.

If the player identifies the name on the clue card 22 correctly, then the player's game piece 16 is advanced one step on the ladder 12 toward the winner's circle 24. The player continues to draw clue cards 22 and advance up the ladder 12 as long as he or she answers the clues correctly. Once a player cannot identify the name on the clue card 22 correctly, the player's turn ends and play rotates clockwise to the next player.

Every ladder contains two wipe out spaces 26 colored in black (in the first embodiment). When a player lands on a wipe out space 26, the other players get to decide the subject box 20 from which the clue card 22 will be drawn. If the player answers the clue correctly, he or she advances to the next space 14 on the ladder 12. If the player answers the clue incorrectly, the player moves his or her game piece 16 two steps backward on the ladder 12 (i.e. away from the winner's circle 24). Play then moves to the next player in the rotation.

When a player reaches the winner's circle 24, he or she must answer one more clue to be honored as the game winner. The other players select a clue card subject from which the player must draw a clue card 22. If the player answers correctly, the player is declared the winner of the game. If the player answers incorrectly, the player must wait for his or her next turn to attempt to answer another clue selected by the other players.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of playing a word game between a first player and a second player, the method comprising the steps of:

a) providing a kit comprising:

a game playing surface having a plurality of ladders, wherein an individual ladder is comprised of spaces and has a start and a finish, wherein each space is associated with a particular subject;

a plurality of game pieces; and a plurality of game cards, wherein the game cards are comprised of clues and answers, wherein the clue to each game card provides a definition for a word corresponding to each syllable in the answer, wherein each game card is associated with a particular subject and wherein the clue is comprised of first name clue and a last name clue, wherein the first name clue and the last name clue are separated by the word "and", further wherein the clue is directed to a person's name, wherein a symbol "/" is used to separate syllables in the person's name;

b) positioning a first player game piece at a first space on a first ladder;

c) positioning a second player game piece at a second space on a second ladder;

d) drawing a first game card;

e) announcing an answer consistent with the clue and the particular subject of the card; and f) comparing an answer to the answer on the first card; landing on finish space and answering one more clue correctly to be the winner.

2. The method of claim 1 wherein providing a kit further comprises a die useful for determining which of a first player and a second player goes first in a game.

3. The method of claim 1 further comprising making a movement selected from the group consisting of: (1) moving the first player game piece to a third space on the first ladder; and (2) moving the second player game piece to a fourth space on the second ladder.

4. The method of claim 3 wherein making a movement is selected from the group consisting of: (1) first player moving the first player game piece to a second space on the first ladder and repeating steps d) through f) when the play is with the first player and the guess matches the answer; (2) second player moving the second player game piece to a second space on the second ladder and repeating steps d) through f) when the play is with the second player and the guess matches the answer; (3) first player passing play to the second player when the guess does not match the answer and play is with the first player; and (3) second player passing play to the first player when the guess does not match the answer and play is with the second player.

5. The method of claim 3 wherein providing a kit further comprises a wipeout space.

6. The method of claim 5 wherein drawing the game card is selected from the group consisting of: (1) second player drawing the card and picking from any subject when the first player is on the wipeout space and play is with the first player; and (1) first player drawing the card and picking from any subject when the second player is on the wipeout space and play is with the second player.

7. The method of claim 5 wherein making a movement is performed by the first player and is selected from the group consisting of: (1) moving the first player game piece forward one space when the guess matches the answer, when the first player game piece is on the wipeout space, and when play is with the first player; (2) moving the second player game piece forward one space when the guess matches the answer, when the second player game piece is on the wipeout space, and when play is with the second player; (3) moving the first player game piece backward two spaces and turning play over to the second player when the guess does not match the answer, the first player game piece is on the wipeout space, and play is with the first player; and (4) moving the second player game piece backward two spaces and turning play over to the first player when the guess does not match the answer, the second player game piece is on the wipeout space, and play is with the second player.

8. The method of claim 1 wherein providing a kit further comprises a winner's circle.

9. The method of claim 8 wherein drawing the game card is selected from the group consisting of: (1) second player drawing the card and picking from any subject when the first player is in the winner's circle and play is with the first player; and (2) first player drawing the card and picking from any subject when the second player is in the winner's circle and play is with the second player.

10. The method of claim 1 wherein the games cards have the clues on a first side and the answers on the other side.

11. A word game comprising:

a game playing surface having a plurality of ladders, wherein an individual ladder is comprised of spaces and has a start and a finish;

a plurality of game pieces;

a plurality of game cards, wherein the game cards are comprised of clues and answers, wherein the clue to each game card provides a definition for a word corresponding to each syllable in the answer, wherein each game card is associated with a particular subject and wherein the clue is comprised of first name clue and a last name clue, wherein the first name clue and the last name clue are separated by the word "and", further wherein the clue is directed to a person's name, wherein a symbol "/" is used to separate syllables in the person's name; and a die.

12. The method of claim 11 wherein the games cards have the clues on a first side and the answers on a second side.

* * * * *